US009802679B2

(12) United States Patent
Janik

(10) Patent No.: US 9,802,679 B2
(45) **Date of Patent: *Oct. 31, 2017**

(54) HYBRID WINCH WITH CONTROLLED RELEASE AND TORQUE IMPULSE GENERATION CONTROL FOR ANCHOR HANDLING OFFSHORE

(71) Applicant: John Bradford Janik, Houston, TX (US)

(72) Inventor: John Bradford Janik, Houston, TX (US)

(73) Assignee: Electronic Power Design, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/159,819

(22) Filed: May 20, 2016

(65) Prior Publication Data

US 2016/0347421 A1 Dec. 1, 2016

Related U.S. Application Data

(63) Continuation of application No. 14/558,489, filed on Dec. 2, 2014, now Pat. No. 9,365,265.

(51) Int. Cl.

| | |
|---|---|
| ***B63B 21/50*** | (2006.01) |
| ***B66D 1/12*** | (2006.01) |
| ***B66D 1/60*** | (2006.01) |
| ***B66D 1/50*** | (2006.01) |
| *B63J 99/00* | (2009.01) |

(52) U.S. Cl.

CPC ..... *B63B 21/50* (2013.01); *B66D 1/12* (2013.01); *B66D 1/505* (2013.01); *B66D 1/60* (2013.01); *B63B 2021/505* (2013.01); *B63B 2708/02* (2013.01); *B63J 2099/006* (2013.01); *B66D 2700/0141* (2013.01)

(58) Field of Classification Search

None

See application file for complete search history.

(56) References Cited

U.S. PATENT DOCUMENTS

| | | | | |
|---|---|---|---|---|
| 3,102,434 A * | 9/1963 | Cramer, Jr. | B66D 1/24 | 254/267 |
| 4,475,163 A * | 10/1984 | Chandler | B63B 21/00 | 377/17 |
| 4,476,801 A * | 10/1984 | Foster | B63B 21/50 | 114/230.23 |
| 4,755,947 A * | 7/1988 | Braschler | G05D 1/0208 | 405/158 |
| 5,803,008 A * | 9/1998 | Georgens | B63B 21/04 | 114/293 |
| 6,374,765 B1 * | 4/2002 | Marotta | B63B 21/22 | 114/293 |

(Continued)

*Primary Examiner* — Jonathan M Dager

(74) *Attorney, Agent, or Firm* — G. Michael Roebuck, PC

(57) ABSTRACT

A hybrid winch system is disclosed, including but not limited to an electric winch; an electric generator for providing generator power to the electric winch; a battery for providing stored power to the electric winch; an anchor cable wound around a roller drum for the electric winch; an anchor attached to a distal end of the anchor cable; and a controller for applying the generator power and the stored power to the electric winch. A method for controlling the hybrid winch is also disclosed.

6 Claims, 5 Drawing Sheets

(56) References Cited

U.S. PATENT DOCUMENTS

| | | | | |
|---|---|---|---|---|
| 6,595,493 | B2 * | 7/2003 | Krebs | B66C 13/44 254/266 |
| 7,263,946 | B2 * | 9/2007 | Worthy | B63B 21/20 114/293 |
| 7,520,490 | B1 * | 4/2009 | Lee | B66D 1/72 254/358 |
| 2003/0107030 | A1 * | 6/2003 | Sozzi | B66D 1/12 254/362 |
| 2011/0074165 | A1 * | 3/2011 | Grimes | E21B 3/02 290/40 C |
| 2013/0241444 | A1 * | 9/2013 | Fotherby | H02M 7/48 318/51 |
| 2013/0307444 | A1 * | 11/2013 | Settemsdal | B60L 7/14 318/139 |
| 2013/0313894 | A1 * | 11/2013 | Settemsdal | H02J 4/00 307/9.1 |
| 2014/0197768 | A1 * | 7/2014 | Haugen | H02J 4/00 318/442 |
| 2014/0239871 | A1 * | 8/2014 | Savva | B66D 1/12 318/504 |
| 2015/0239546 | A1 * | 8/2015 | Limseth | B63H 23/24 440/6 |
| 2016/0009530 | A1 * | 1/2016 | Teruzzi | B66C 13/12 191/12.2 R |
| 2016/0114862 | A1 * | 4/2016 | Janik | B63B 21/50 701/21 |
| 2016/0159625 | A1 * | 6/2016 | Janik | B66D 1/485 701/21 |

* cited by examiner

HYBRID WINCH WITH CONTROLLED RELEASE AND TORQUE IMPULSE GENERATION CONTROL FOR ANCHOR HANDLING OFFSHORE

BACKGROUND OF THE INVENTION

There is a need for additional control over setting and reclaiming anchor handling for offshore semisubmersible oil rigs.

SUMMARY OF THE INVENTION

In one embodiment of the present invention a hybrid winch with controlled release and torque impulse generation control for anchor handling is disclosed. In another embodiment a method for using a hybrid winch with controlled release and torque impulse generation control for anchor handling is disclosed.

DETAILED DESCRIPTION

Floating oil rigs are constructed on floating platforms that are anchored to the sea bed. The floating platforms are tethered to the anchors with cables. One of the most dangerous jobs at sea is anchoring the floating oil rig platforms. These tethering cables are up to 3 inches in diameter and can be up to 3 miles long. Anchoring vessels set the anchors in the sea bed and winch the end of the tethering cable connected to the anchor to create tension on the cable and to set the anchor in the seabed. The anchoring vessel pulls on the anchor end of the tethering cable to set the anchor. The anchoring vessel resists the pull of the tension placed on the anchor cable with the vessel's propulsion system, typically a diesel engine. If the vessel's propulsion system fails, the pull of the anchor cable can submerge the vessel, risking the lives of the crew about the anchoring vessel. In addition, if the vessel propulsion system fails, tension on the tethering cable can pull the anchoring vessel backwards without the benefit steerage in the reverse direction or the benefit of active resistance of the vessel propulsion system.

In a particular embodiment of the invention, a hybrid winch is provided that includes but is not limited to a diesel engine and an electric motor to control tension on the anchor cable during anchoring. In another embodiment, a hybrid winch is provided that includes but is not limited to a hydraulic motor and an electric motor to control tension on the anchor cable during anchoring. In a particular embodiment of the invention, a hybrid winch is provided that includes but is not limited that includes but is not limited to a hydraulic engine, a diesel engine and an electric motor to control tension on the anchor cable during anchoring. In a particular embodiment of the invention, a hybrid winch is provided that includes but is not limited to a dynamic torque impulse generator. In a particular embodiment the dynamic torque impulse generator includes but is not limited to an impulse generator processor connected to a non-transitory computer readable medium.

In a particular embodiment, a hybrid winch is provided with torque impulse generation control for anchor handling. The winch is electrically driven from a diesel fueled generator on an anchor handler vessel at sea, with an additional battery powered source to provide additional winch horse power to provide extra pull when needed for setting an anchor in the sea bed off shore for stabilizing a floating oil rig. The hybrid winch can also provide backup power for the winch in case the diesel fueled generator loses power. In the case of power loss, the backup power provides for controlled release when the boat loses power to keep the winch from pulling the boat under water without cutting the cable attached to the anchor.

Figure 1:
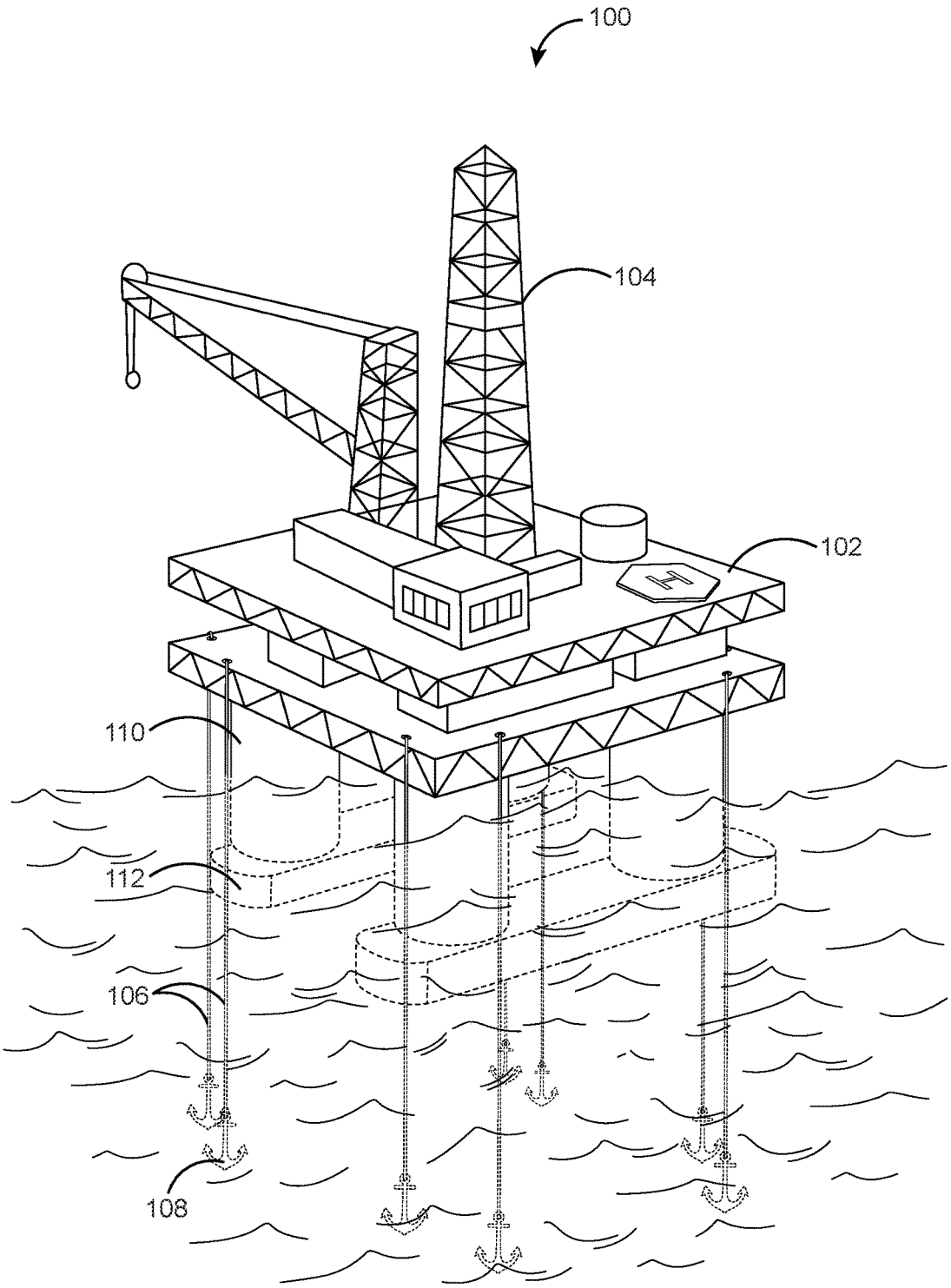
FIG. 1 depicts an orthographic projection of a schematic depiction of an illustrative embodiment having a floating semisubmersible oil platform anchored to a seabed.

FIG. 1 depicts a floating semisubmersible oil platform anchored to a seabed. The floating oil rig is a floating semi-submersible platform 102 supporting drilling and production infrastructure 104. Each corner of the platform 102 is tethered to two anchor cables 106 which are each anchored to the sea bed with an anchor 108.

Figure 2:
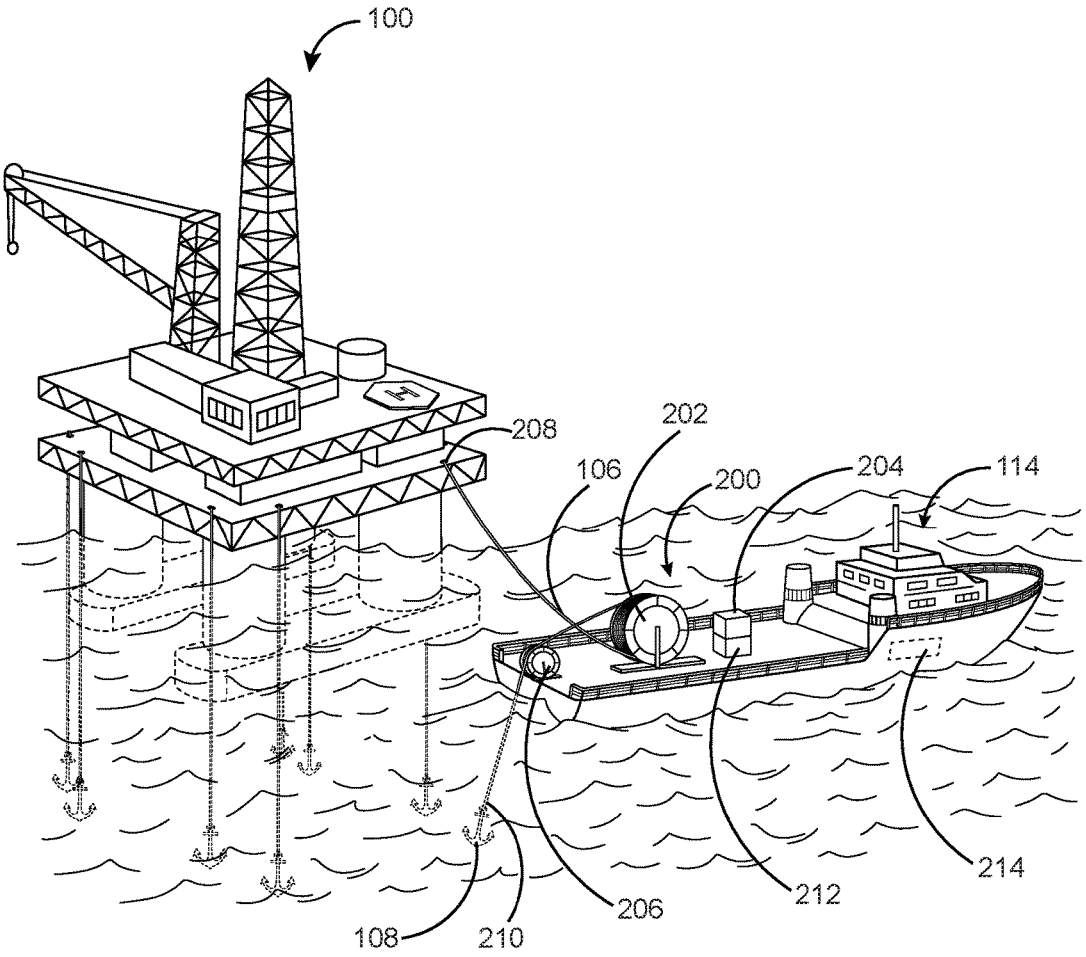
FIG. 2 depicts an orthographic projection of a schematic depiction of an illustrative embodiment having an anchor handler vessel having a hybrid winch system.

FIG. 2 depicts a particular embodiment of an anchor handler vessel having a particular embodiment of the hybrid winch system. A vessel 202 supports a winch controller 204 and a hybrid winch 206. The hybrid winch 206 is rotationally attached to anchor cable 106. The submersible floating oil rig is attached to one end of anchor cable 106 and an anchor 108 is attached to the other end of anchor cable 106. The hybrid winch has two power supplies, diesel engine 214 powered generator 204 and a backup battery 212. The generator 204 is powered by a diesel engine on the vessel 202.

Figure 3:
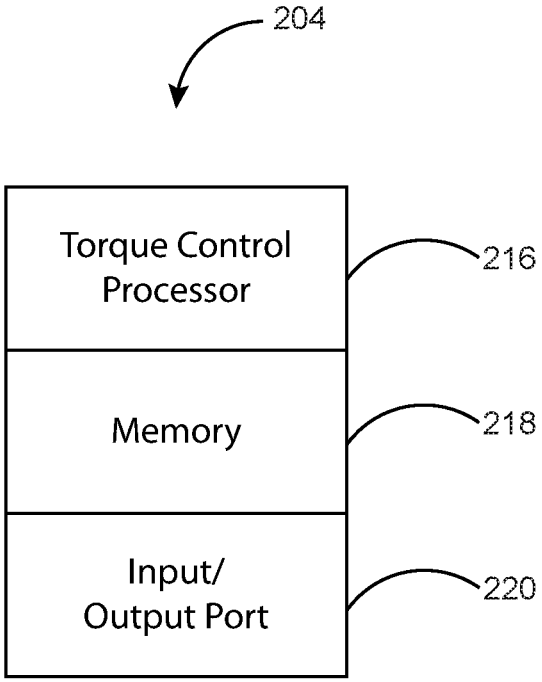
FIG. 3 depicts a block diagram of an illustrative embodiment of a control system for the hybrid winch.
Figure 4:
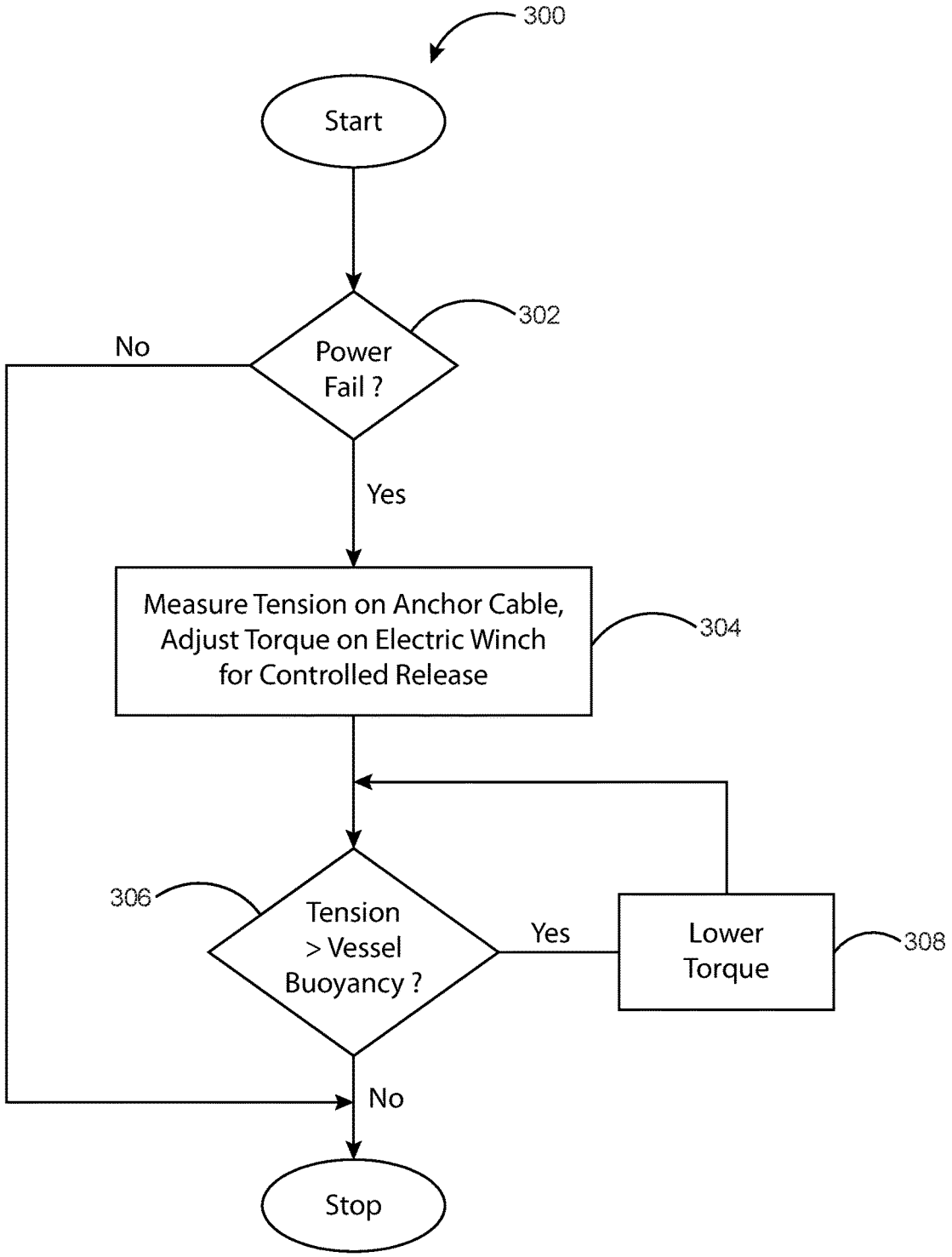
FIG. 4 depicts a drawing of a flow chart for using the hybrid winch.

FIG. 3 depicts an illustrative embodiment of a control system 300 for the hybrid winch. The control system 300 includes but is not limited to a torque control processor 302, a non-transitory computer readable medium memory 304 and an input output port for sensing the state of the hybrid winch and controlling the hybrid winch. A computer program is stored in the memory 304. The computer program automatically performs a controlled release on engine fail as shown in FIG. 4. The computer program automatically performs a controlled torque profile program when setting an anchor as shown in FIG. 5.

FIG. 4 depicts a flow chart for using the hybrid winch. As shown in FIG. 4, in an illustrative embodiment a controlled release method is performed at the anchor controller by controlling the winch 206. As shown in FIG. 4, the computer program starts at 402. At 404 the computer program checks to see if there has been a power failure on the anchoring vessels. If the vessel loses power the computer program measures the tension on the anchor cable and adjusts the transitory on the anchor cable to perform a controlled release at 406. If the tension on the cable is greater than the buoyancy of the boat at 408, the computer program proceeds to 410 and lowers the torque and returns to 408. If the tension on the cable is not greater than the buoyancy of the boat at 408, the computer program proceeds to 412 and exits.

Figure 5:
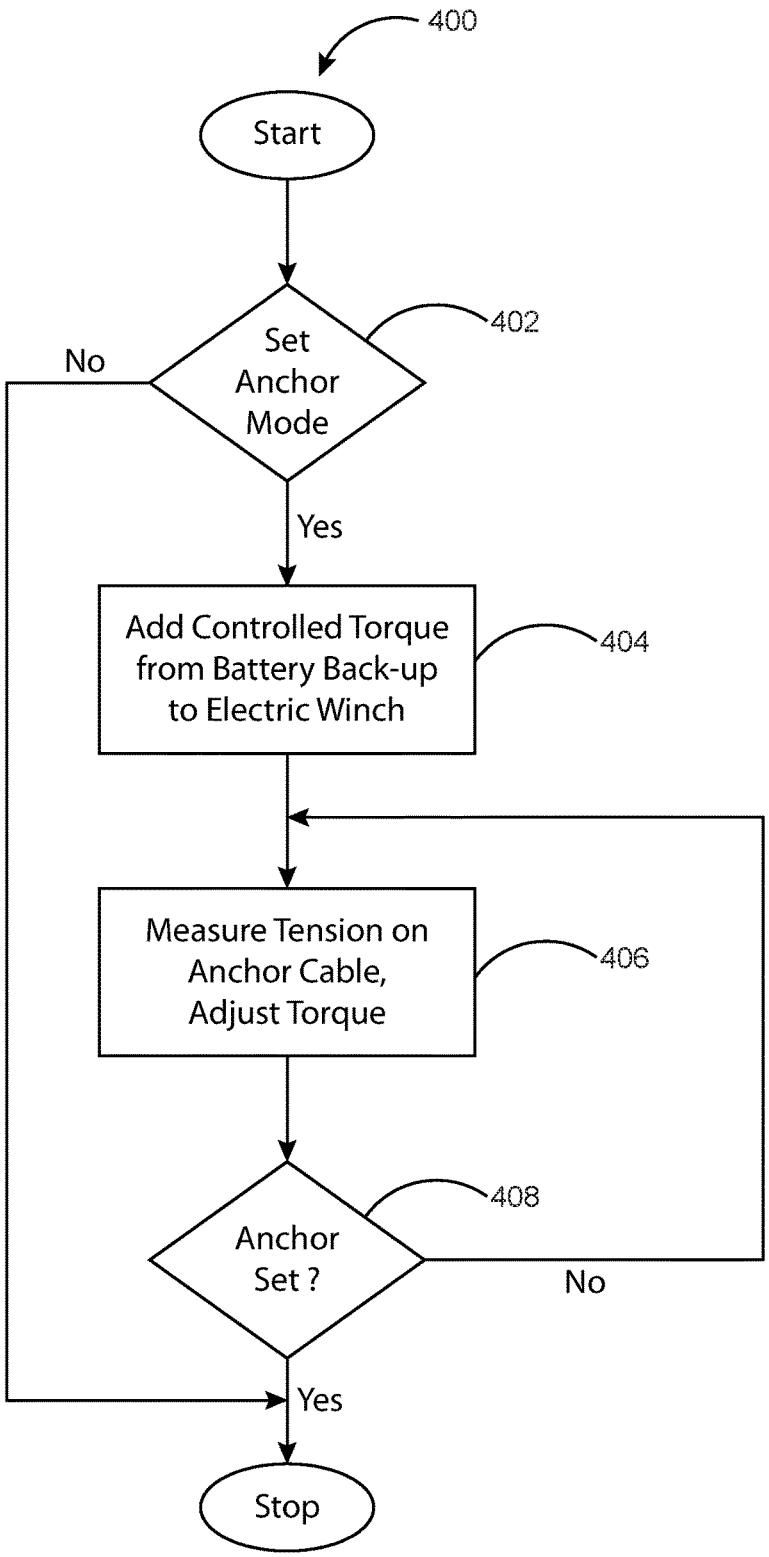
FIG. 5 depicts a drawing of a flow chart for using the hybrid winch.

FIG. 5 depicts another flow chart 500 for using the hybrid winch. As shown in the flow chart in FIG. 5, the computer program starts at 502 and proceeds to determine if the set anchor mode is set. If the set anchor mode is not set the computer program exits at 512. If the set anchor mode is set, the computer program proceeds to 506 add controlled torque to the hybrid wench using the battery backup to add horse power. Different controlled torque profiles are available and are selected based on the stage of anchor deployment and the anchor's engagement with the sea bed. A first set of toque profiles for the hybrid winch are selected for removing anchors for the sea bed. A second set of toque profiles for the hybrid winch are selected for setting anchors for the sea bed. In another particular embodiment, a neural network computer program is provided to learn a successful torque profile for removing an anchor from the seabed. In another particular embodiment, a neural network computer program is provided to learn a successful torque profile for setting an anchor in the seabed. In another particular embodiment, a neural network computer program is provided to learn a successful torque profile for removing an anchor from the seabed.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A hybrid winch system, the system comprising:

an electric winch;

an electric generator for providing generator power to the electric winch;

a battery for providing stored power to the electric winch;

an anchor cable wound around a roller drum for the electric winch;

an anchor attached to a distal end of the anchor cable; and a controller for applying the generator power and the stored power to the electric winch;

a controller processor;

a non-transitory computer readable medium in data communication with the controller processor; and a computer program stored in the non-transitory computer readable medium, the computer program comprising:

instructions to determine if generator power failed;

instructions to exit the program if the generator power has not failed;

and instructions to, when the generator power has failed, measure tension on an anchor cable attached to the winch and an anchor and instructions to adjust torque of the winch pulling the anchor cable in a controlled release.

2. The system of claim 1, the computer program further comprising:

instructions to determine if the tension on the anchor cable is greater than a buoyancy of the vessel and instructions to lower the torque on the until the tension on the cable is less than the buoyancy of the vessel.

3. The system of claim 1, the system further comprising:

a controller processor;

a non-transitory computer readable medium in data communication with the controller processor; and a computer program stored in the non-transitory computer readable medium, the computer program comprising instructions to determine if an set anchor mode is turned on;

instructions to exit if the set anchor mode is not turned on;

instructions to, when the anchor mode is turned on, add controlled torque from the battery back up to the hybrid winch, and (a) instructions to measure tension on the anchor cable;

instructions to determine if the anchor is set; and instructions to, if the anchor is set, to exit the program; and instructions to the anchor is not set, return to step (a).

4. A method for controlling a hybrid winch, the method comprising:

determining at a winch controller processor if generator power failed;

exiting the program if the generator power has not failed; and measuring tension on an anchor cable attached to the winch and an anchor and instructions to adjust torque of the winch pulling the anchor cable in a controlled release, when the generator power has failed.

5. The method of claim 4, further comprising:

determining at the winch controller processor if the tension on the anchor cable is greater than a buoyancy of the vessel and instructions to lower the torque on the until the tension on the cable is less than the buoyancy of the vessel.

6. The method of claim 4, the method further comprising:

determining at the controller processor if an set anchor mode is turned on;

adding controlled torque from the battery back up to the hybrid winch when the anchor mode is turned on; and (a) measuring tension on the anchor cable;

determining if the anchor is set; and if the anchor is not set, return to step (a).

* * * * *